US011306948B2

(12) United States Patent
Odani et al.

(10) Patent No.: US 11,306,948 B2
(45) Date of Patent: Apr. 19, 2022

(54) LIQUEFACTION PROMOTING APPARATUS HAVING VIBRABLE AND OSCILLABLE SPRING

(71) Applicant: CPM HOLDING CO., LTD., Tokyo (JP)

(72) Inventors: Hajime Odani, Tokyo (JP); Mikinari Masumoto, Tokyo (JP)

( * ) Notice: Subject to any disclaimer, the term of this patent is extended or adjusted under 35 U.S.C. 154(b) by 0 days.

(21) Appl. No.: 15/733,344

(22) PCT Filed: Feb. 5, 2018

(86) PCT No.: PCT/JP2018/003769
§ 371 (c)(1),
(2) Date: Jul. 2, 2020

(87) PCT Pub. No.: WO2019/135292
PCT Pub. Date: Jul. 11, 2019

(65) Prior Publication Data

US 2020/0386449 A1 Dec. 10, 2020

(30) Foreign Application Priority Data

Jan. 4, 2018 (JP) ..... JP2018-000228

(51) Int. Cl.

| | |
|---|---|
| ***F25B 13/00*** | (2006.01) |
| ***F25B 41/40*** | (2021.01) |
| ***F25B 1/00*** | (2006.01) |
| ***F25B 39/04*** | (2006.01) |

(52) U.S. Cl.
CPC ..... *F25B 13/00* (2013.01); *F25B 41/40* (2021.01); *F25B 1/00* (2013.01); *F25B 39/04* (2013.01); *F25B 2339/047* (2013.01); *F25B 2600/2513* (2013.01)

(58) Field of Classification Search
CPC .. B01F 11/00; F25B 41/00; F25B 1/00; F25B 39/04; F25B 2339/047; F25B 2600/2513; F25B 13/00; F25B 41/40; F25B 2400/16
See application file for complete search history.

(56) References Cited

U.S. PATENT DOCUMENTS

2020/0141618 A1* 5/2020 Odani ..... B01F 15/066

FOREIGN PATENT DOCUMENTS

JP 2015212601 A * 11/2015

OTHER PUBLICATIONS

Translation JP-2015212601-A.*

* cited by examiner

*Primary Examiner* — Elizabeth J Martin
(74) *Attorney, Agent, or Firm* — Rosenberg, Klein & Lee

(57) ABSTRACT

A fluid stirring and liquefaction promoting apparatus is coupled to a pipeline of a heat pump system to enable uniform mixture of refrigerator oil with refrigerant to improve the heat exchange efficiency of the heat pump system and to reduce the energy consumption. The liquefaction promoting apparatus is configured with a cylindrical housing, a system of tubes fluidly coupled between the pipeline and the interior of the cylindrical housing, as well as large and a small coil springs disposed in the cylindrical housing. Being actuated by the kinetic energy of the fluids circulating in the cylindrical housing, the large and small coil springs vibrate and oscillate to stir and mix the fluids to result in their uniform mixture.

14 Claims, 16 Drawing Sheets

(a)

(b)

(a)

(b)

(a)

(b)

(a)

(b)

(a)

(b)

(a)

(b)

(a)

(b)

LIQUEFACTION PROMOTING APPARATUS HAVING VIBRABLE AND OSCILLABLE SPRING

TECHNICAL FIELD

The present invention relates to a liquefaction promoting apparatus for promoting fluid liquefaction by stirring which is disposed on a pipeline of a heat pump system. It relates, more specifically, to an apparatus equipped with a spring capable of vibration and oscillation for an enhanced mixture of fluids.

BACKGROUND ART

Patent Document 1 discloses a refrigerating cycle equipped with a gas-liquid mixing device, which is designed to improve operating efficiency. The gas-liquid mixing device employs a decompression device for adjusting dryness, a refrigerant conduit and a U-tube.

Patent Document 2 discloses an apparatus for recombining impurities contained in refrigerant. It has a cylindrical housing formed with a helical groove on its inner wall which shears impurities and allows the impurities to be recombined.

Patent Document 3 discloses a heat pump system equipped with a stirring device. The stirring device has a cylindrical housing and an axially movable coil spring accommodated in the housing.

Patent Document 4 discloses a heat pump system equipped with a liquefaction promoting apparatus. The liquefaction promoting apparatus has a cylindrical housing with a pair of end panels and a conical spring having a base part disposed adjacent to one of the end plates.

Patent Document 5 discloses refrigeration and air-conditioning system equipped with a refrigerant processing unit. The refrigerant processing unit has a cylindrical housing formed with an internal helical groove and accommodates a conduit formed with a helical groove on its outer wall.

PRIOR ART DOCUMENT

Patent Document

Patent Document 1: Japanese Patent Published No. 3055854.

Patent Document 2: Japanese Patent Laid-open No. 2014-161812.

Patent Document 3: Japanese Patent Laid-open No. 2015-212601.

Patent Document 4: Japanese Patent Published No. 5945377.

Patent Document 5: Japanese Patent Published No. 2017-142061.

DISCLOSURE OF THE INVENTION

Problems to be Solved by the Invention

In the refrigerating cycle shown in Patent Document 1, fluid consisting of the mixture of gas and liquid is circulated. The operating efficiency of the cycle is improved by promoting liquefaction of the mixture of gas and liquid.

Shown in Patent Documents 2 to 5 are stirring devices which are typically composed of a cylindrical housing formed with an internal helical groove or accommodating an internal coil spring.

As a result of thorough studies on the internal structure of this type of stirring devices in order to further improve the operating efficiency, the inventor has come up with the idea of employing a coil spring which is capable of vibration and oscillation.

It is an object of the present invention to provide a liquefaction promoting apparatus designed to improve the operating efficiency of heat pump cycles.

Means for Solving the Problems

According to the present invention, there is provided a liquefaction promoting apparatus to be disposed on a pipeline of a heat pump system for the purpose of stirring and uniformly mixing fluid containing refrigerant and refrigerator oil circulating therein. The subject apparatus comprises: a cylindrical housing having a body part, and an upper and a lower dome-shaped end plates each sealing the upper and the lower end of said body part; an upper tube having one end connectable to the pipeline and the other end penetrating said upper dome-shaped end plate at a distant position from the central axis and extending to the periphery of the upper end of said body part, allowing the fluid to flow therethrough; a lower tube having one end connectable to the pipeline and the other end penetrating said lower dome-shaped end plate in the vicinity of the central axis and extending to the periphery of the upper end of said body part, allowing the fluid to flow therethrough; a large coil spring with a diameter 1 to 10 mm smaller than the inner diameter of said body part which is accommodated coaxially in said body part, the large coil spring having its upper and lower ends fixed thereon and its middle part unfixed for vibration and oscillation. The middle part of said large coil spring is allowed to vibrate and oscillate by kinetic energy of the flowing fluid, thereby stirring the fluid. The apparatus enables it to stir and uniformly mix the fluid containing refrigerant and refrigerator oil circulating the pipeline, thereby improving the operating efficiency of the heat pump system.

The liquefaction promoting apparatus is characterized in that it further comprises at least one small coil spring with a diameter 1 to 30 mm larger than the outer diameter of said lower tube which is accommodated in said body part and around said lower tube, said at least one small coil spring having its upper end fixed on the upper end of said lower tube and its lower end extending to the periphery of said lower dome-shaped end plate; wherein said at least one small coil spring vibrates and oscillates without colliding with said large coil spring. The apparatus enables the large and small coil springs to cooperatively vibrate and oscillate so as to stir and uniformly mix the fluid containing refrigerant and refrigerator oil circulating along the pipeline, thereby improving the operating efficiency of the heat pump system.

The liquefaction promoting apparatus is characterized in that said large coil spring is unequally pitched in such a manner that its upper part has a wide pitch size, its middle part has a narrow pitch size and its lower part has a wide pitch size. Alternatively, the upper part of the large coil spring has a narrow pitch size, its middle part has a wide pitch size and its lower part has a narrow pitch size. The liquefaction promoting apparatus is characterized in that said at least one small coil spring is unequally pitched in such a manner that its upper part has a wide pitch size, its middle part has a narrow pitch size and its lower part has a wide pitch size, or that its upper part has a narrow pitch size, its middle part has a wide pitch size and its lower part has a narrow pitch size. The apparatus enables the large and small coil springs to flexibly vibrate and oscillate, thereby improving the effectiveness of stirring and mixing.

The liquefaction promoting apparatus is characterized in that said other end of said upper tube is inclined upward in the radial direction away from the axis. The apparatus enables it to vary the direction of the fluid exiting from the upper tube and colliding with the coil springs, thereby improving the effectiveness of stirring and mixing.

The liquefaction promoting apparatus is characterized in that it further comprises at least three coil springs each being either of said large coil spring and said at least one small coil spring. The apparatus can be used for a high power heat pump system.

According to the present invention, there is provided a method for promoting liquefaction of the fluid by stirring and uniformly mixing it using the liquefaction promoting apparatus comprising the steps of: (a) in the cooling mode of operation, entering the fluid containing refrigerant and refrigerator oil through said upper tube from a condenser, or an outdoor unit disposed on the pipeline; (b) stirring and uniformly mixing the fluid by the action of vibration and oscillation of said large coil spring and said at least one small coil spring; and (c) expelling the fluid through said lower tube. This method enables it to improve the operating efficiency of the heat pump system.

According to the present invention, there is provided a method for promoting liquefaction of the fluid by stirring and uniformly mixing it using the liquefaction promoting apparatus comprising the steps of: (a) in the heating mode of operation, entering the fluid containing refrigerant and refrigerator oil through said lower tube; (b) stirring and uniformly mixing the fluid by the action of vibration and oscillation of said large coil spring and said at least one small coil spring; and (c) expelling the fluid through said upper tube to an evaporator, or an outdoor unit disposed on the pipeline. This method enables it to improve the operating efficiency of the heat pump system.

Effects of the Invention

As described above, the present invention provides a liquefaction promoting apparatus for stirring and mixing refrigerant and refrigerator oil, thereby improving the operating efficiency of heat pump cycles. Accordingly, the liquefaction promoting apparatus disposed on a pipeline of a heat cycle will effectively reduce the energy consumption.

BRIEF DESCRIPTION OF THE DRAWINGS

FIG. 1(*a*) shows the flow of fluid in cooling operation. FIG. 1(*b*) shows the flow of fluid in heating operation.

BEST MODE FOR CARRYING OUT THE INVENTION

Figure 1:
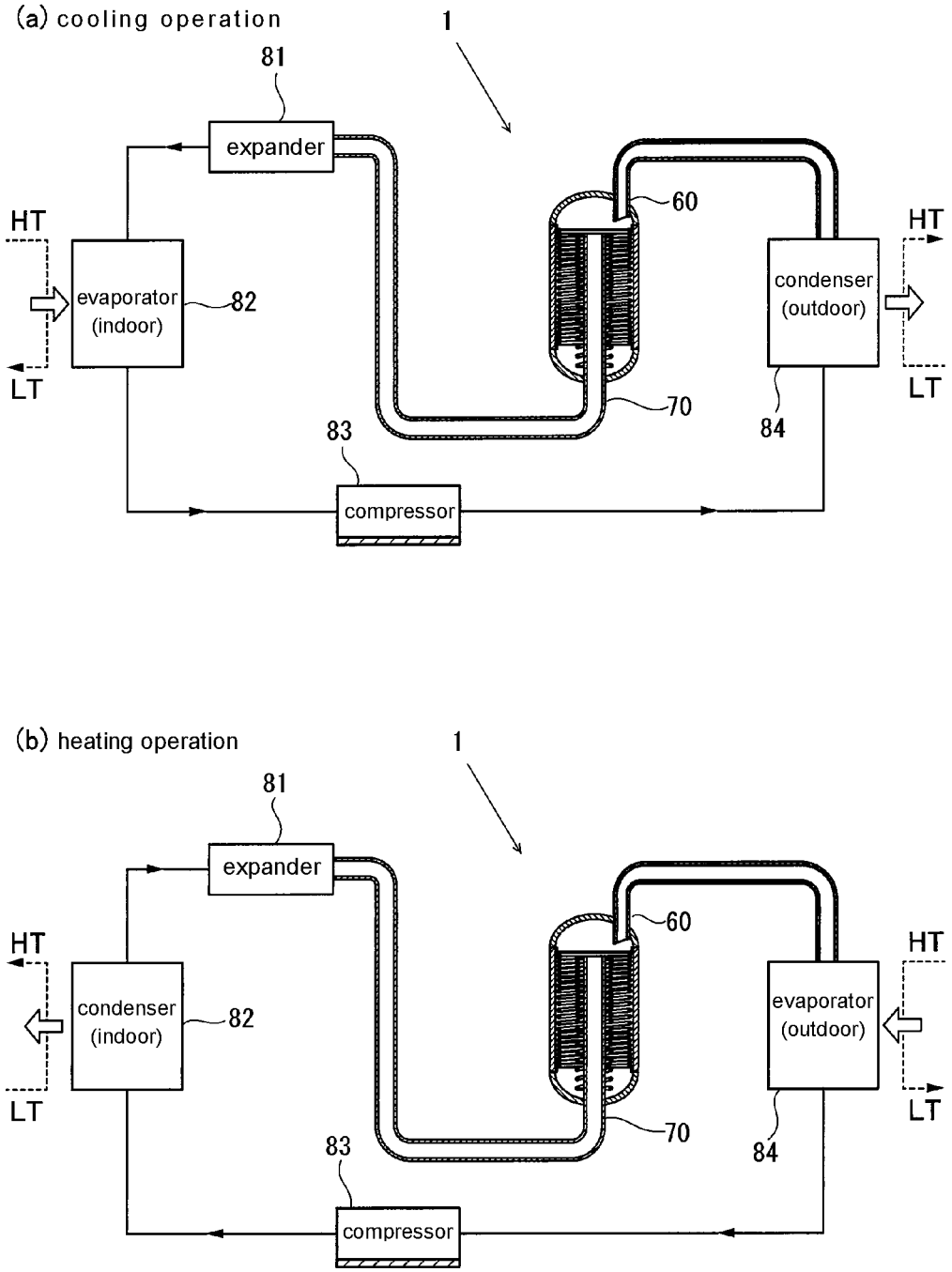
FIG. 1 is a view showing an example of a liquefaction promoting apparatus applied to a heat pump system.

Described hereinafter with reference to the attached drawings are detailed embodiments of the apparatus according to the present invention. In the figures, like reference numerals refer to like members which have similar basic composition and operation.

<First Embodiment>

<Configuration>

FIG. 1 is a view showing an example of a liquefaction promoting apparatus applied to a heat pump system. The heat pump system may be an air-conditioner, a freezer, a refrigerator, a boiler, a freezing warehouse, a chiller and the like. It is not limited to a heat pump system run by electricity but may also be that run by other types of power source such as a gas turbine. The liquefaction promoting apparatus can be adapted either to a yet-to-be-made heat pump system or to an existing heat pump system.

A heat pump system takes heat from a low temperature object and gives heat to a high temperature object for the purpose of cooling the low temperature object and/or warming the high temperature object. An air-conditioner switching between cooling operation and heating operation is also a heat pump system.

The term "fluid" used herein refers to that circulated through a heat pump cycle. It includes refrigerant and refrigerator oil. It can be either in a liquid, gas or gas-liquid-mixture state in a heat pump cycle. For the refrigerant, CFC substitute is employed.

FIG. 1 shows a cross-sectional schematic view of a heat pump cycle adapted to an air-conditioner. FIG. 1(*a*) shows the flow of fluid in cooling operation, in the counterclockwise direction. FIG. 1(*b*) shows the flow of fluid in heating operation, in the clockwise direction.

The heat pump cycle in its cooling operation consists of a compressor 83, a condenser (outdoor unit) 84, an expander 81 and an evaporator (indoor unit) 82. The heat pump cycle in its heating operation consists of a compressor 83, a condenser (indoor unit) 82, an expander 81 and an evaporator (outdoor unit) 84. These components together with pipelines form an enclosed conduit in which fluid circulates. The arrows in FIG. 1(*a*) and FIG. 1(*b*) indicate the flow direction of the fluid. The void arrows indicate transfer of heat from and into the condenser and the evaporator. The broken arrows indicate transfer of heat between the outdoor and the indoor. "LH" means low temperature and "HT" means high temperature.

<<Heat Pump Cycle in Cooling Operation>>

In the heat pump cycle in its cooling operation shown in FIG. 1(*a*), the compressor 83 has a sealed chamber with a refrigerator oil reservoir. The compressor 83 compresses gaseous refrigerant to have a high pressure and high temperature, which is mixed with the refrigerator oil and discharged to the condenser (outdoor unit) 84. In cooling operation, the condenser (outdoor unit) 84 conducts heat exchange by having the incoming high-temperature high-pressure gaseous fluid to dissipate heat to the outside and to be cooled and liquefied. The liquefied fluid is desirably a uniform mixture or solution of refrigerant and refrigerator oil.

While the refrigerant is liquefied in the condenser (outdoor unit) 84, there remains refrigerator oil which have not been mixed with or dissolved in the refrigerant or which have been fused to form oil phases enveloping liquefied refrigerant. There also remains refrigerator oil in the form of high-pressure gas even after passing the condenser (outdoor unit) 84. Thus, the liquefied fluid discharged from the condenser (outdoor unit) 84 possibly contains unmixed refrigerator oil, refrigerant enveloped in the oil phases of the refrigerator oil and/or gaseous refrigerant.

As shown in FIG. 1(*a*), the liquefaction promoting apparatus 1 in its cooling operation is disposed between the condenser (outdoor unit) 84 and the expander 81. The upper tube 60 of the liquefaction promoting apparatus 1 is communicated with the outlet of the condenser (outdoor unit) 84 while the lower tube 70 is communicated with the inlet of the expander 81. The fluid discharged from the condenser 84 is effectively sheared and mixed in the liquefaction promoting apparatus 1.

Thus, the refrigerator oil having been unmixed is uniformly mixed with the liquefied refrigerant, refrigerant having been enveloped in the oil phases of the refrigerator oil is released and the residual gaseous refrigerant is liquefied. The fluid flows from the liquefaction promoting apparatus 1 to the expander 81.

The expander 81 has an expansion valve or a capillary tube. The liquid fluid with low temperature and low pressure passes through small tubes or pores to have further lower temperature and lower pressure and released to the evaporator (indoor unit) 82. The low-temperature low-pressure liquid fluid absorbs heat from the outside so as to evaporate into a high-temperature gaseous fluid. This causes the indoor air to be cooled. The gaseous fluid flows into the compressor 83.

<<Heat Pump Cycle in Heating Operation>>

In the heat pump cycle in its heating operation shown in FIG. 1(*b*), the fluid flows in the adverse direction. The heat pump system has a switching valve (not shown) for switching the flow direction of the fluid. When in heating operation, the compressor 83 discharges high-temperature high-pressure gaseous fluid, which flows into the condenser (indoor unit) 82. The incoming high-temperature high-pressure gaseous fluid dissipates heat to the outside and is liquefied. This causes the indoor air to be warmed.

Similar to the case in the above described cooling operation shown in FIG. 1(*a*), the liquefied fluid discharged from the condenser (indoor unit) 82 possibly contains unmixed refrigerator oil, refrigerant enveloped in the oil phases of the refrigerator oil and/or gaseous refrigerant. In heating operation, the liquefied fluid discharged from the condenser (indoor unit) flows into the expander 81, where it is expanded to have a low pressure and low temperature. The fluid having passed through the expander 81 still possibly contains unmixed refrigerator oil, refrigerant enveloped in the oil phases of the refrigerator oil and/or gaseous refrigerant.

As shown in FIG. 1(*b*), the liquefaction promoting apparatus 1 in its heating operation is disposed between the expander 81 and the evaporator (outdoor unit) 84. The lower tube 70 of the liquefaction promoting apparatus 1 is communicated with the outlet of the expander 81 while the upper tube 60 is communicated with the evaporator (outdoor unit) 84. The fluid discharged from the expander 81 is effectively sheared and mixed in the liquefaction promoting apparatus 1. Thus, the refrigerator oil having been unmixed is uniformly mixed with the liquefied refrigerant, refrigerant having been enveloped in the oil phases of the refrigerator oil is released and the residual gaseous refrigerant is liquefied. The fluid flows from the liquefaction promoting apparatus 1 to the evaporator (outdoor unit) 84.

In the heating operation, the evaporator (outdoor unit) 84 conducts heat exchange by having the incoming low-temperature low-pressure liquid fluid to absorb heat from the outside and to be heated and vaporized. The vaporized fluid flows into the compressor 83.

As shown in FIG. 1(*a*) and FIG. 1(*b*), the liquefaction promoting apparatus 1 according to the present invention is inserted on a pipeline of a heat pump system. Since such a pipeline consists of several tubular members, the liquefaction promoting apparatus 1 can easily be adapted to a heat pump system by replacing one of the tubular members thereof. It may be installed on an outdoor part of the pipeline.

Described above is an embodiment of the liquefaction promoting apparatus 1 adapted to a basic-type heat pump system according to the present invention. The liquefaction promoting apparatus 1 can also be adapted to different types of heat pump system equipped with various additional components. It can be adapted to, for example, a heat pump system equipped with a gas-liquid separator. It can also be adapted to a heat pump system having an ejector and a gas-liquid separator in place of an expander.

Figure 2:
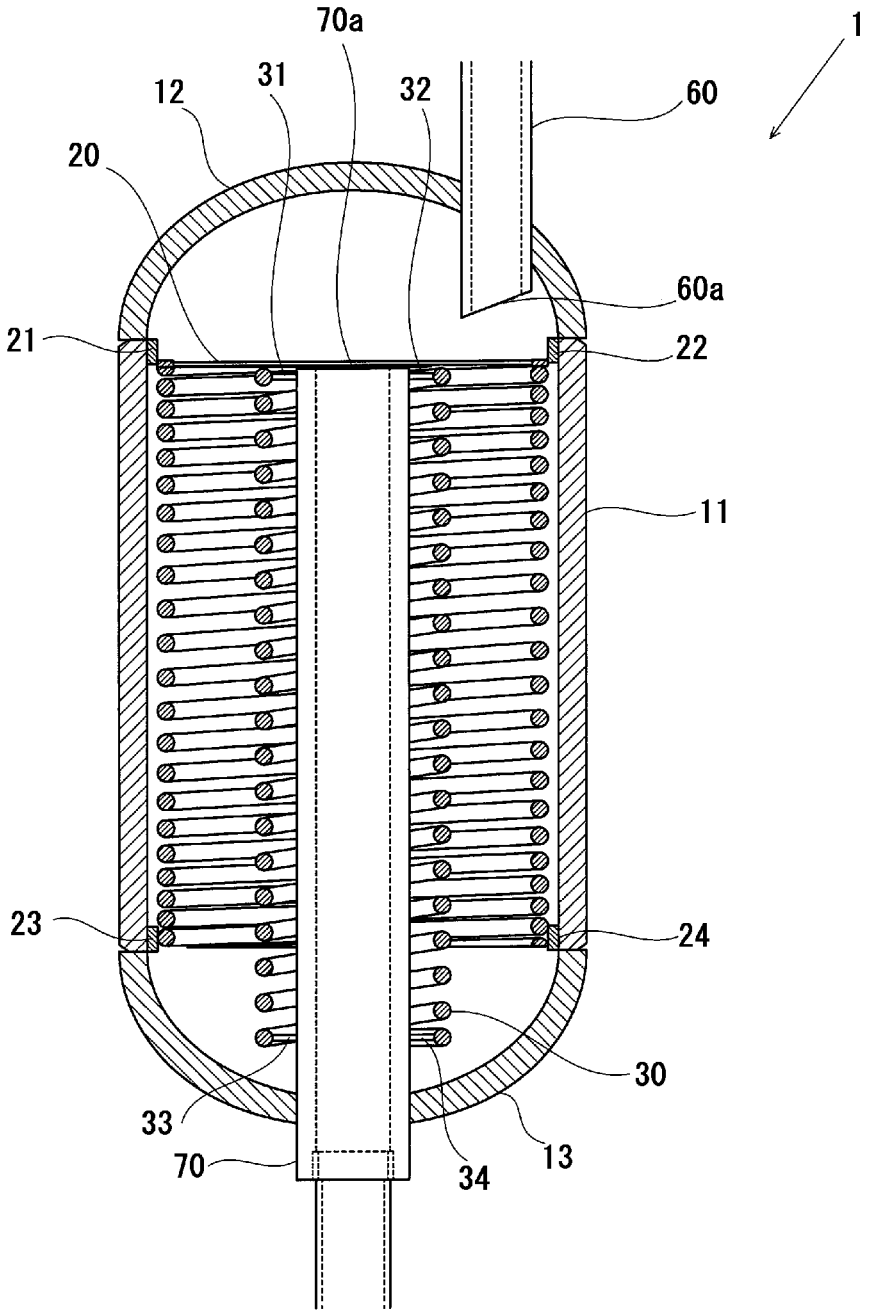
FIG. 2 is a cross-sectional schematic view of the liquefaction promoting apparatus according to the present invention.
Figure 3:
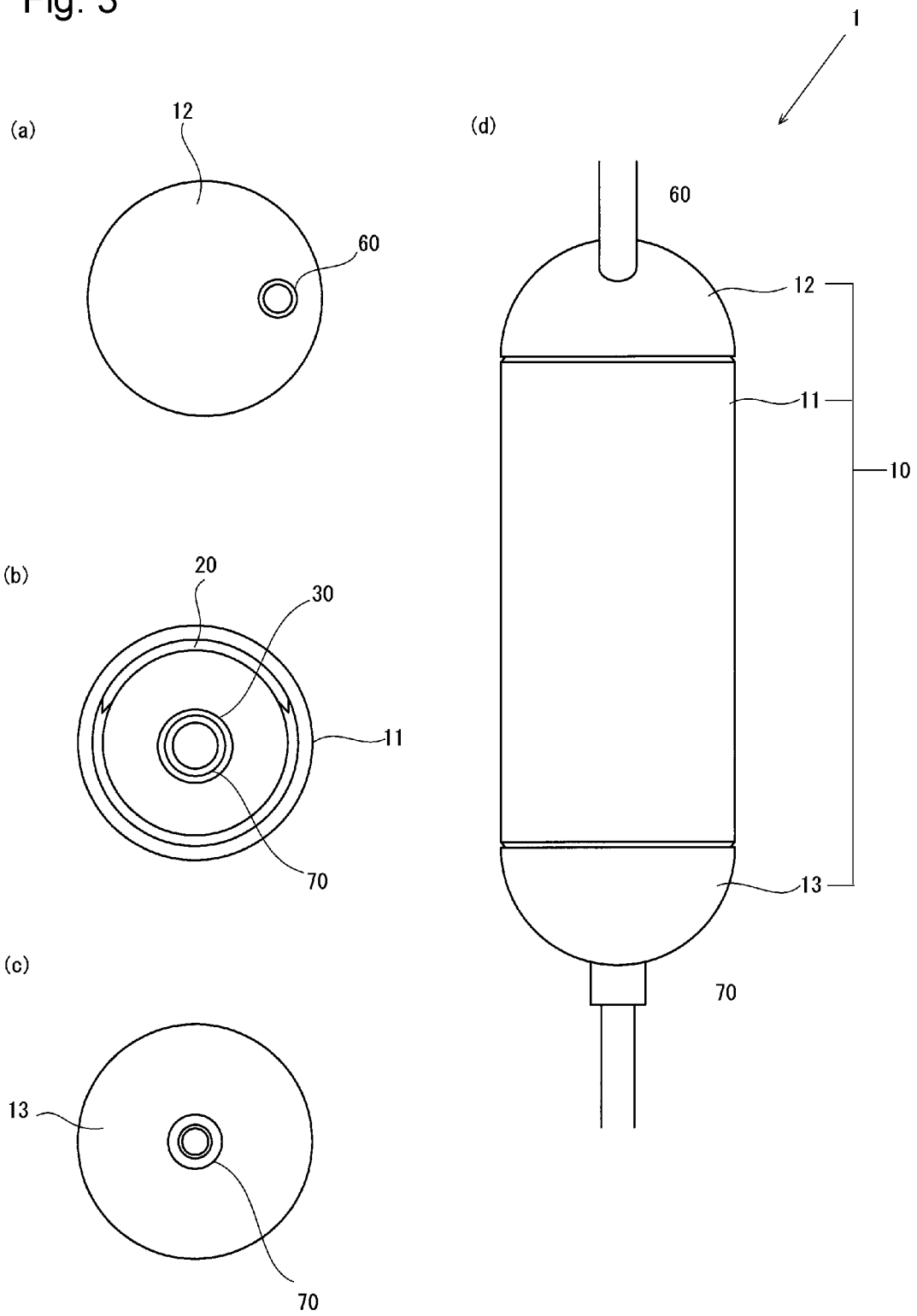
FIG. 3 is an overview of the liquefaction promoting apparatus according to the present invention.

FIG. 2 is a cross-sectional schematic view of the liquefaction promoting apparatus according to the present invention. FIG. 3 is an overview of the liquefaction promoting apparatus according to the present invention. The liquefaction promoting apparatus 1 comprises a cylindrical housing 10 having a body part 11, an upper dome-shaped end plate 12 and a lower dome-shaped end plate 13. For the purpose of allowing refrigerant and refrigerator oil to flow therethrough at a pressure of 0.2 MPa to 10 MPa, the liquefaction promoting apparatus 1 is required to withstand such high pressure. Since the liquefaction promoting apparatus 1 allows to flow therethrough fluid having been let out of the compressor 83, it is also considered to be a pressure vessel. A pressure vessel is usually equipped with dome-shaped "end plates" for sealing its upper and lower ends. As shown in the figures, the upper end plate 12 and the lower end plate 13 each has a hemispherical cross-section with the same radius as the body part 11.

The liquefaction promoting apparatus 1 further comprises an upper tube 60 and a lower tube 70 for letting fluid in and out of the cylindrical housing 10. FIG. 3(*d*) shows a side view of the liquefaction promoting apparatus 1. The upper tube is disposed to penetrate the upper end plate 12 and the lower tube 70 is disposed to penetrate the lower end plate 13. The liquefaction promoting apparatus 1 is disposed on a pipeline of a heat pump system by connecting one ends of the upper tube 60 and the lower tube 70 respectively to the ends of the pipeline. Since fluid flows in the counterclockwise direction when in cooling operation and in the clockwise direction when in heating operation, as shown in FIG. 1(*a*) and FIG. 1(*b*), it is not required to change the disposition of the liquefaction promoting apparatus 1 even when the operation is switched.

The upper tube 60 lets in fluid from the condenser 84 (outdoor unit) in cooling operation, and lets out fluid to the evaporator 84 (outdoor unit) fluid in heating operation.

The upper tube 60 penetrates the upper end plate 12 in the axial direction at a distant position from the central axis. The upper tube 60 extends to the periphery of the upper end of the body part 11, with its lower end 60*a* open. As shown in FIG. 2, the lower end 60*a* of the upper tube 60 is preferably inclined upward in the radial direction away from the axis. This inclination yields a flow of the fluid containing refrigerant and refrigerator oil which suitably causes a large coil spring 20 and a small coil spring 30 to vibrate and oscillate so as to effectively shear and mix the fluid, and promote its liquefaction.

The lower tube 70 lets out fluid to the expander 81 in cooling operation, and lets in fluid from expander 81 in heating operation. The lower tube 70 penetrates the lower end plate 13 in the axial direction in the vicinity of the central axis. The lower tube 70 extends to the periphery of the upper end of the body part 11, with its upper end 70*a* open.

The large coil spring 20 is disposed in and coaxially with the body part 11 with its outer surface distant in 1 to 10 mm from the inner wall thereof. The large coil spring 20 has four fixing parts 21, 22, 23 and 24. These fixing parts of the large coil spring 20 each firmly fixes its upper or lower end onto the inner wall of the body part 11 while leaving its middle part unfixed so to vibrate and oscillate. The term "oscillate" herein describes the coil spring 20 oscillating in its extending and shrinking direction, and the term "vibrate" herein describes the coil spring 20 vibrating in directions different from its extending and shrinking direction. The large coil spring 20 may have more than two fixing parts each on its upper or lower end.

Figure 4:
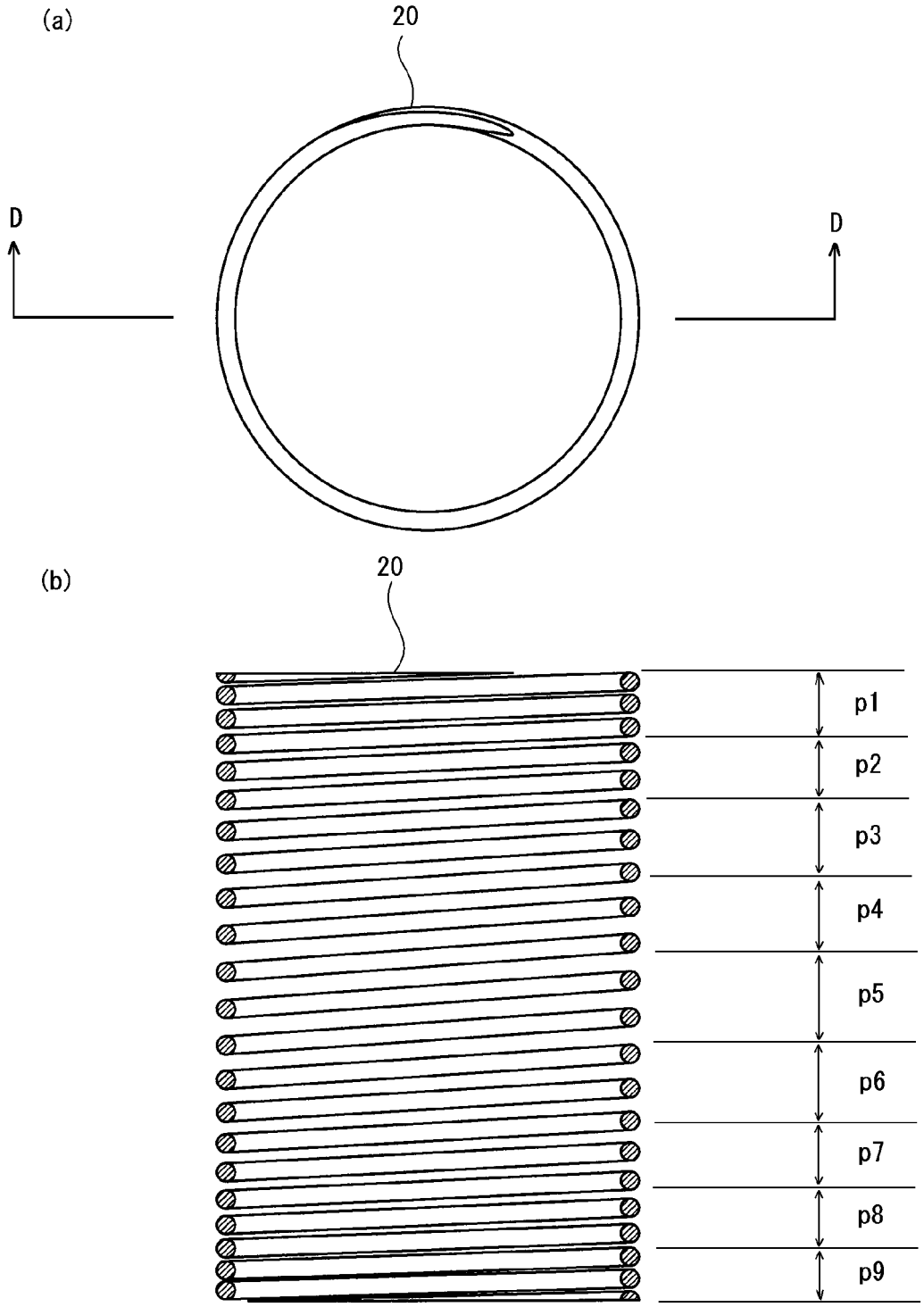
FIG. 4 shows the structure of a large coil spring used in the liquefaction promoting apparatus according to the present invention.

The large coil spring 20 has its upper and lower parts narrowly pitched and its middle part widely pitched, as shown in FIG. 4.

The cylindrical housing 10, the upper tube 60, the lower tube 70, the large coil spring 20 and the small coil spring 30 are made of materials which are suitable for the components of a pressure vessel, such as steel.

The small coil spring 30 has four fixing parts 31, 32, 33 and 34. These fixing parts of the small coil spring 30 each firmly fixes its upper or lower end onto the outer wall of the lower tube while leaving its middle part unfixed to vibrate and oscillate. The small coil spring 30 may have more than two fixing parts each on its upper or lower end. The small coil spring 30 preferably has its upper and lower parts narrowly pitched and its middle part widely pitched.

FIG. 4(*a*) is a plain view of the large coil spring 20 and FIG. 4(*b*) is a cross-sectional view along the D-D line of the same.

The large coil spring 20 is unequally pitched in a gradually widening manner from each end toward the middle part. Suppose that the large coil spring 20 has nine parts, p1, p2, p3 . . . and p9. The pitch size of each part is defined as the length of a gap between two adjacent wires. In this example, p1 and p9 each has a pitch size of 0.8 mm, p2 and p8 1.2 mm, p3 and p7 1.6 mm, p4 and p6 2.0 mm, and p5 2.5 mm. In any other example of the liquefaction promoting apparatus according of this embodiment, the pitch sizes of nine parts of the large coil spring 20 are determined so as to satisfy the following condition.

$$p1<p2<p3<p4<p5>p6>p7>p8>p9 \quad p1=p9, p2=p8, p3=p7, p4=p6$$

Each part of the large coil spring 20 (p1, p2, p3 . . . ) may have a constant pitch size, or may have gradually narrowing or widening sizes.

The flow of refrigerant and refrigerator oil through the liquefaction promoting apparatus 1 causes the large coil spring 20 to vibrate and oscillate so as to shear the fluid. Surface roughness of the large coil spring 20 also promotes the shearing effect. The fluid is micronized and is uniform, and thus is liquefied. The large coil spring 20 is disposed so as to be 1 to 10 mm spaced apart from the inner wall of the body part 11 of the cylindrical housing 10. While its upper and lower ends are fixed onto the cylindrical housing 10, other parts freely vibrate and oscillate.

As shown in FIG. 2, the small coil spring 30 is also preferably unequally pitched such as to have its upper and lower parts narrowly pitched and its middle part widely pitched.

The small coil spring 30 has its upper end fixed on the upper end of the lower tube 70 and its lower end fixed on the outer wall of the lower tube 70, by welding or other methods.

The small coil spring 30 is disposed so as to surround the lower tube 70 to vibrate and oscillate at a position 1 to 30 mm distant from the outer wall thereof. The upper end 70*a* of the lower tube 70 may be made of a flange, which is formed with the fixing parts 31 and 32.

<In-Flow of Fluid Through Upper Tube 60>

Fluid flows into the cylindrical housing 10 through the upper tube 60. The fluid flows down to collide with the lower dome-shaped end plates 13 and shifts its flowing direction upward (U-turn). The fluid then flows up to collide with the upper dome-shaped end plates 12 and shifts its flowing direction downward (U-turn). These actions enhance the flow of the fluid in the vertical direction, effectively stirring and mixing the fluid in the cylindrical housing 10. Since the upper tube 60 is positioned distant from the central axis of the cylindrical housing 10 and its lower end is inclined upward in the radial direction away from the axis, it effectively angles the vertical flow of the fluid. This vertical flow of the fluid causes the large coil spring 20 and a small coil spring 30 to vibrate and oscillate. Collision of the fluid with the vibrating and oscillating coil springs causes effective shearing and mixing of the fluid.

<In-Flow of Fluid Through Lower Tube 70>

Fluid flows into the cylindrical housing 10 through the lower tube 70. The fluid flows up to collide with the upper dome-shaped end plates 12 and shifts its flowing direction downward (U-turn). The fluid then flows down to collide with the lower dome-shaped end plates 13 and shifts its flowing direction upward (U-turn). These actions enhance the flow of the fluid in the vertical direction, effectively stirring and mixing the fluid in the cylindrical housing 10. Furthermore, the fluid collides with the upper tube 60 and the lower tube 70, and IS separated into several streams. The fluid also rubs and collides with the large coil spring 20 and a small coil spring to cause them to vibrate and oscillate.

Collision of the fluid with the vibrating and oscillating coil springs causes effective shearing and mixing of the fluid. The fluid thus effectively stirred and mixed is flown out through the upper tube 60.

<Mechanism of Action>

Described below are the mechanisms of action of overtone resonance (scaling resonance).

In the liquefaction promoting apparatus 1, flow of fluid with a pressure of several megapascals adds impact to the coil springs, forcing them to vibrate and oscillate. The vibration and oscillation are transmitted so as to generate sound, which may be audible or non-audible. The sound is continuously generated as long as the flow of fluid is kept.

Collision of the clusters of refrigerant and refrigerator oil also generates sound. Those two kinds of sound are considered to be in harmonic relationship as the overtone of the former (higher harmonics) resonates the latter (scaling resonance). This is considered to promote stirring and mixing of fluid, and liquefaction.

Scaling resonance is a phenomenon that higher harmonics or overtone, which is tens of octaves higher, causes resonance. (Yōichi Fukagawa (1999), *Protein Music*, Tokyo, Chikuma-shobo.)

Resonance and sympathizing are distinguished herein. Whereas sympathizing occurs when vibration or oscillation is transmitted via solid, resonance occurs when vibration or oscillation is transmitted via fluid such as water and gas.

In the liquefaction promoting apparatus 1, it is considered that the vibration and oscillation of the coil springs is transmitted to refrigerant and refrigerator oil via fluid (liquid material), and thus overtone resonance (scaling resonance) occurs as long as the flow of fluid is kept.

In the liquefaction promoting apparatus 1, fluid, viewed from a macro-viewpoint, imparts impact to the coil spring and causes it to be vibrated and oscillated. Viewed from a micro-viewpoint, clusters of refrigerant and refrigerator oil are caused to be de-clustered by the action of overtone resonance (scaling resonance) and evenly dispersed.

<Effects>

Fluid containing of refrigerant and refrigerator oil is flown through the liquefaction promoting apparatus 1 at a pressure of 0.2 to 10 MPa. The flow imparts impact on the coil spring causes it to be vibrated and oscillated. The vibration and oscillation cause generation of sound waves of various frequencies. Most of the generated higher harmonic waves are considered to be overtones, which are capable of de-clustering the refrigerant and refrigerator oil by the action of sympathizing or resonance. Refrigerant and refrigerator oil are thus evenly dispersed.

<Reduction of Power and Energy Consumption>

The apparatus of the present invention contributes to effective reduction of power and energy consumption when applied in a heat pump system in which refrigerant and refrigerator oil is circulated.

Example 1

Figure 5:
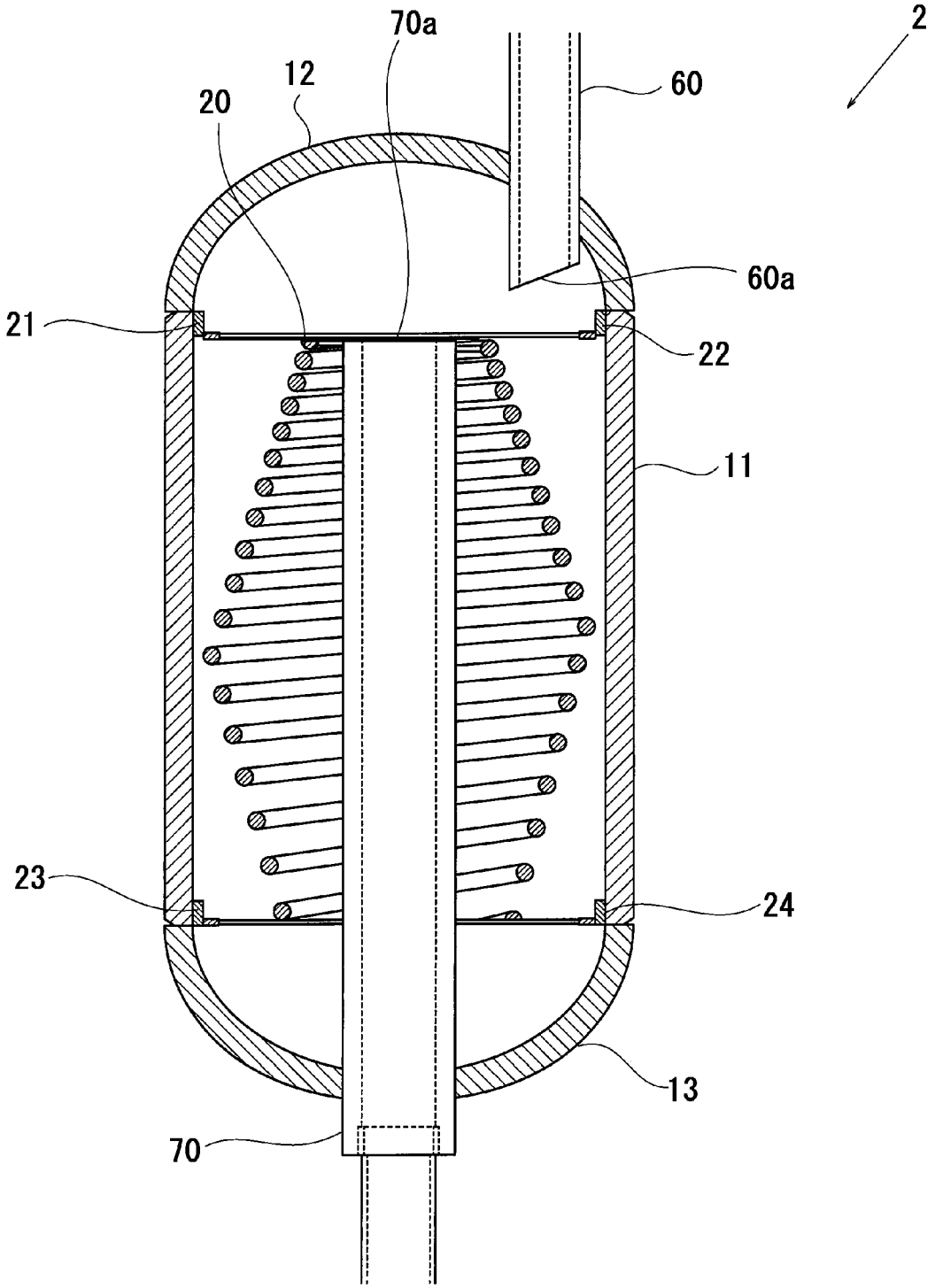
FIG. 5 is a cross-sectional view of a liquefaction promoting apparatus according to the present invention (Example 1).

FIG. 5 is a cross-sectional view of a liquefaction promoting apparatus 2 according to the present invention.

In FIG. 5, the liquefaction promoting apparatus is described, for illustration purpose, to have only a large coil spring 20, with a small coil spring not shown. The large coil spring 20 has smaller diameters in its upper and lower parts and larger diameters in its middle part. The large coil spring 20 is unequally pitched such as to have its upper and lower parts narrowly pitched and its middle part widely pitched. Alternatively, the large coil spring 20 may be unequally pitched in a gradually widening manner from its upper end toward lower end.

Example 2

Figure 6:
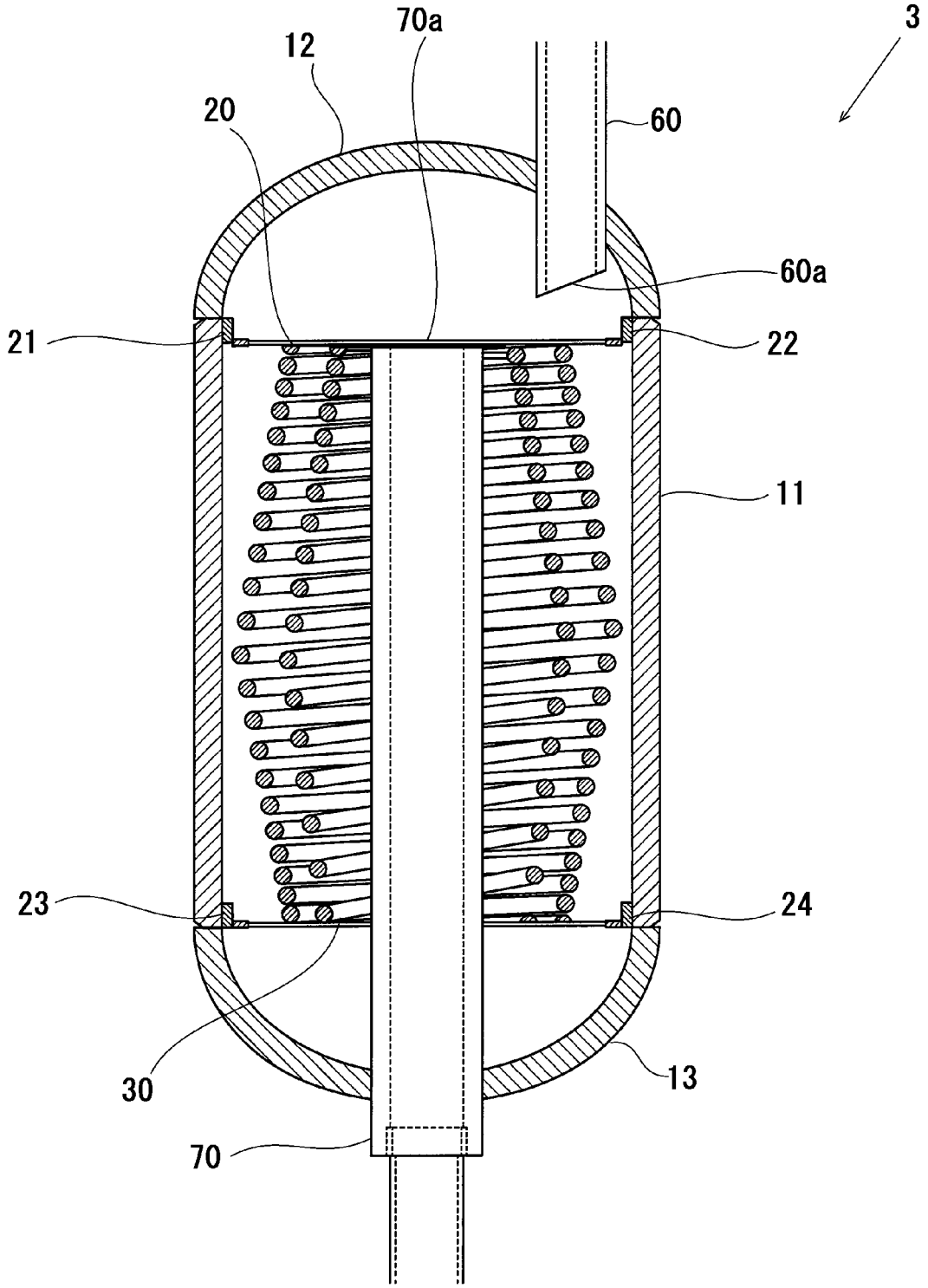
FIG. 6 is a cross-sectional view of a liquefaction promoting apparatus according to the present invention (Example 2).

FIG. 6 is a cross-sectional view of a liquefaction promoting apparatus 3 according to the present invention.

As shown FIG. 5, the liquefaction promoting apparatus 3 has a large coil spring 20 and a small coil spring 30 disposed in a coaxial disposition. Each of the two coil springs has smaller diameters in its upper and lower parts and larger diameters in its middle part. The two coil springs vibrate and oscillate without colliding with each other.

<<Examples of Upper Tube and Lower Tube>>

Figure 7:
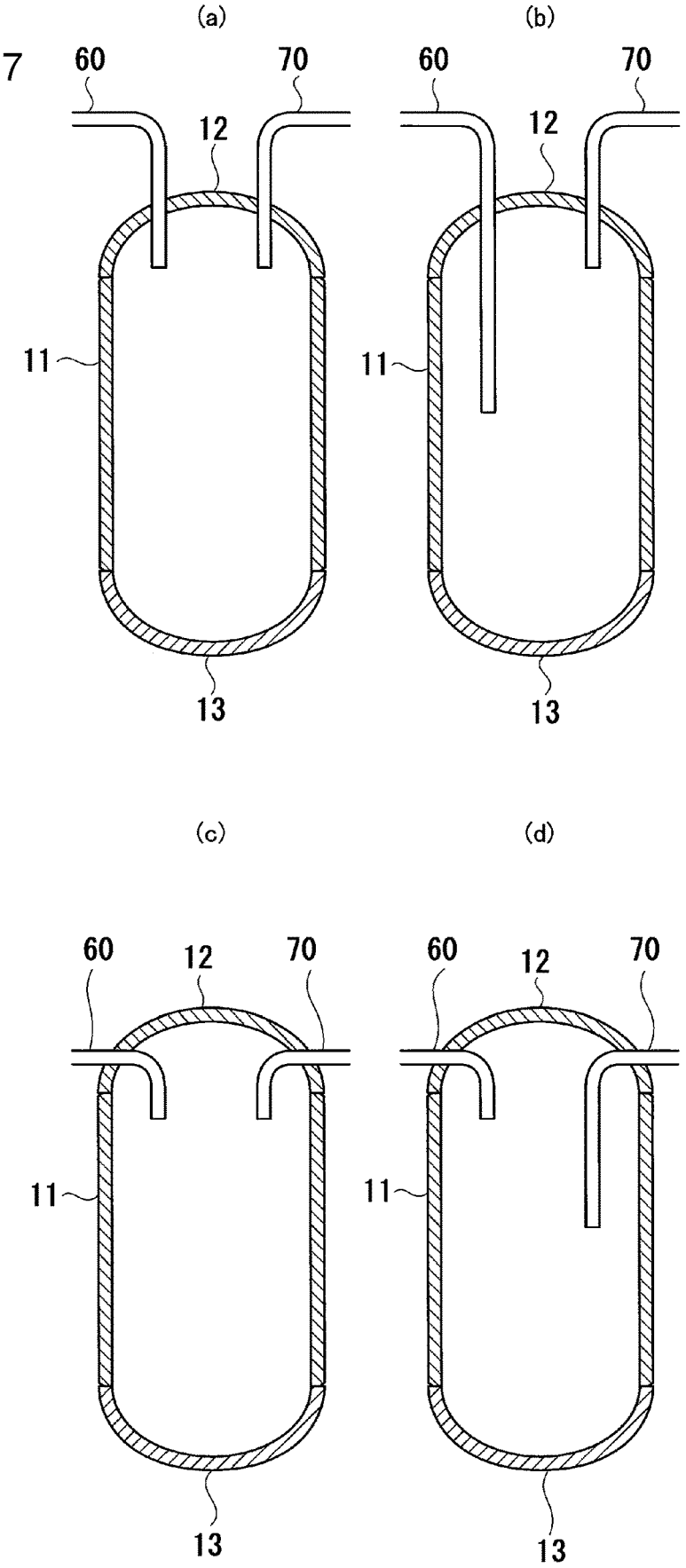
FIG. 7 is a view showing alternative examples of an upper tube and a lower tube.

FIG. 7 is a view showing other examples of an upper tube and a lower tube.

As shown in FIG. 7, the exemplified upper tubes and lower tubes 70 penetrate upper dome-shaped end plates 12 in various forms. Alternatively, upper tubes 60 and lower tubes 70 may be disposed to penetrate lower dome-shaped end plates 13.

<<Examples of Coil Springs with Various Pitches>>

Figure 8:
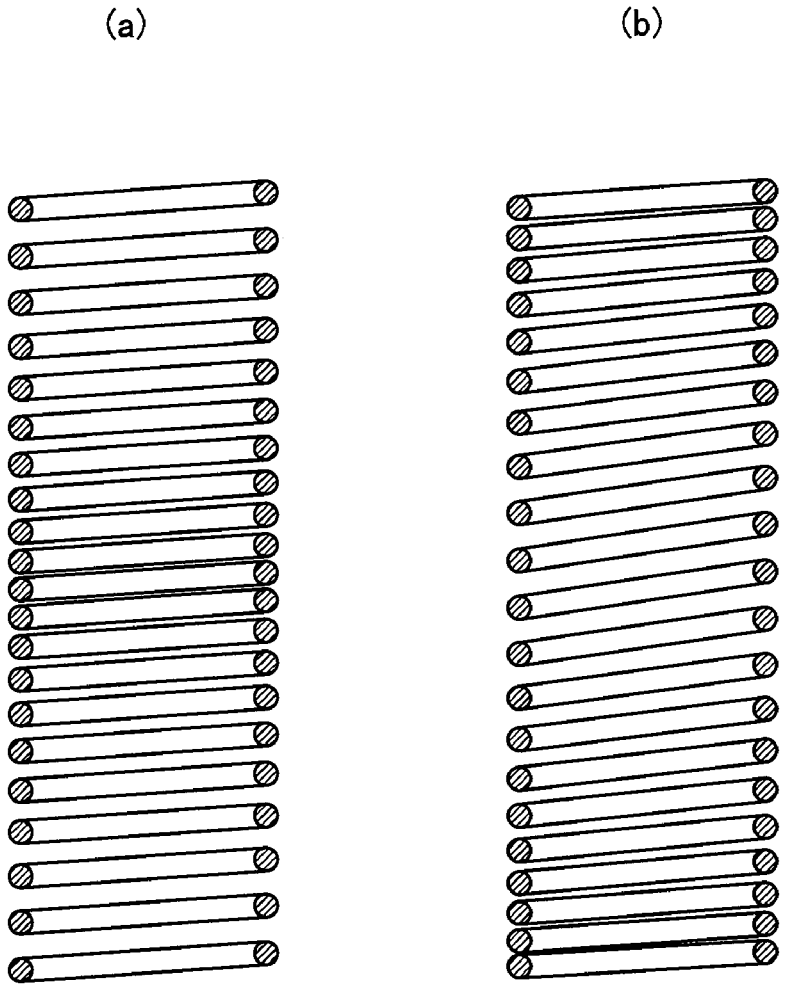
FIG. 8 is a view showing alternative examples of coil springs with various pitches.

FIG. 8 is a view showing other examples of coil springs with various pitches. In FIG. 8(*a*) is shown a coil spring which is unequally pitched such as to have its upper and lower parts widely pitched and its middle part narrowly pitched. In FIG. 8(*b*) is shown a coil spring which is unequally pitched such as to have its upper and lower parts narrowly pitched and its middle part widely pitched.

<<Examples of Coil Springs with Various Diameters>>

Figure 9:
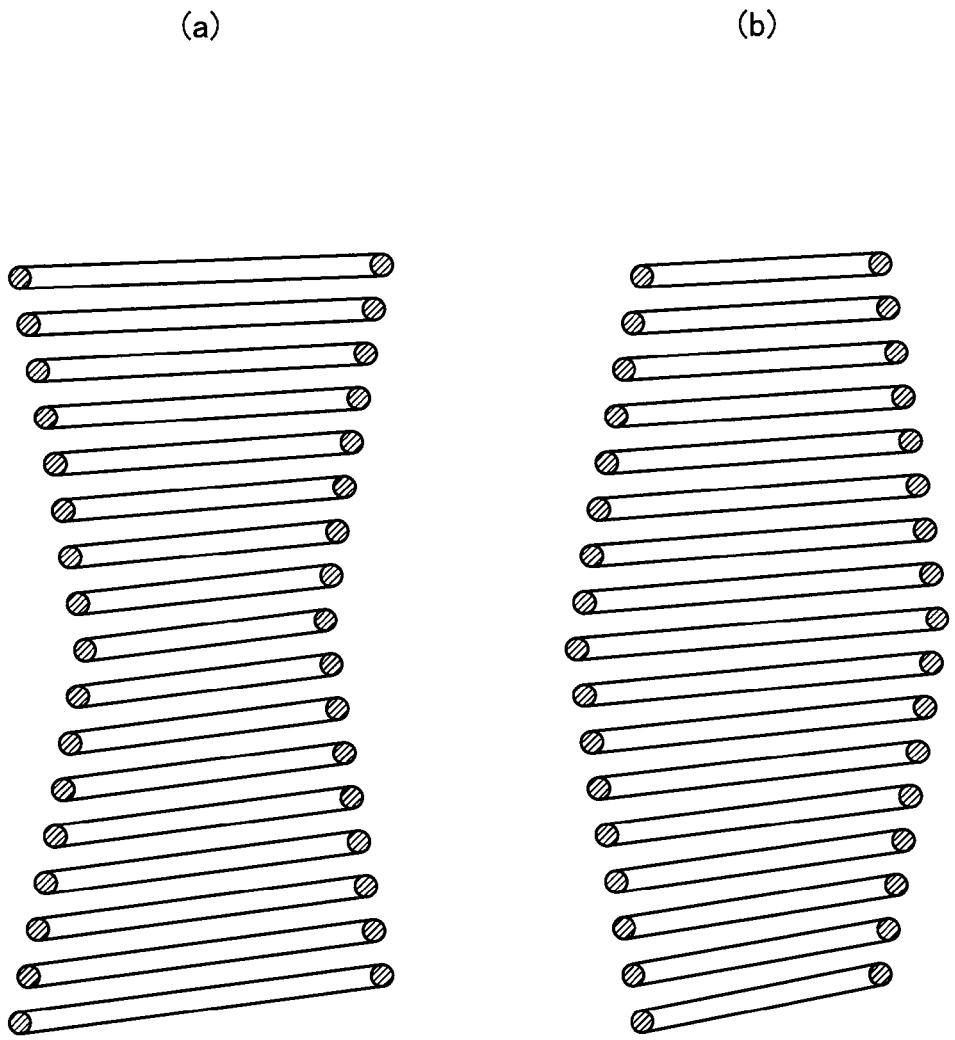
FIG. 9 is a view showing alternative examples of coil springs with various diameters.

FIG. 9 is a view showing other examples of coil springs with various diameters. In FIG. 9(*a*) is shown a coil spring which has larger diameters in its upper and lower parts and smaller diameters in its middle part. In FIG. 9(*b*) is shown a coil spring which has smaller diameters in its upper and lower parts and larger diameters in its middle part.

<<Examples of 3 Concentric Coil Springs>>

Figure 10:
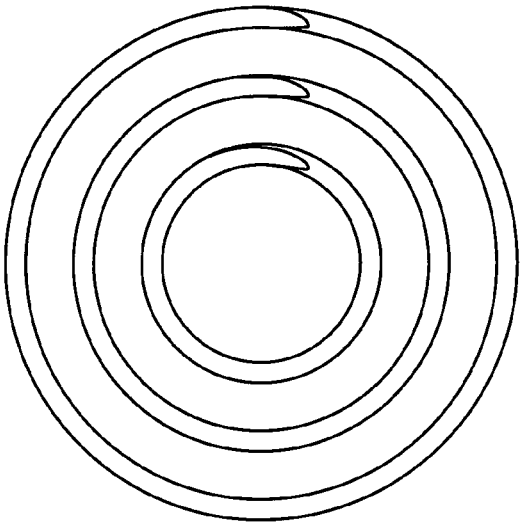
FIG. 10 is a view showing an example of three coil springs which are concentrically disposed.
Figure 10:
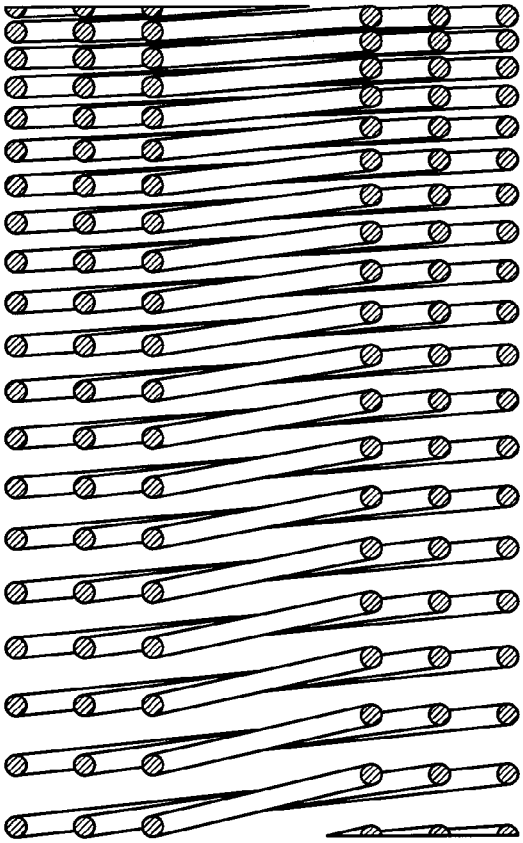

FIG. 10 is a view showing an example of three coil springs which are disposed concentrically such that each vibrates and oscillates without colliding with any other.

<<Examples of 4 Concentric Coil Springs>>

Figure 11:
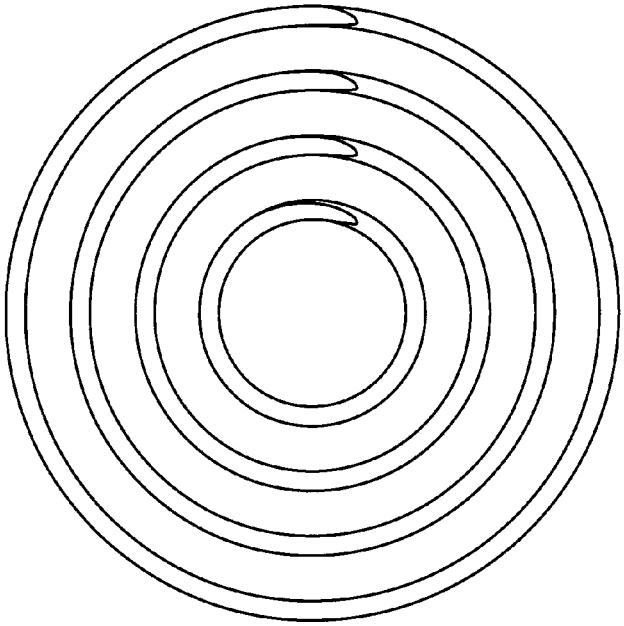
FIG. 11 is a view showing an example of four coil springs which are concentrically disposed.
Figure 11:
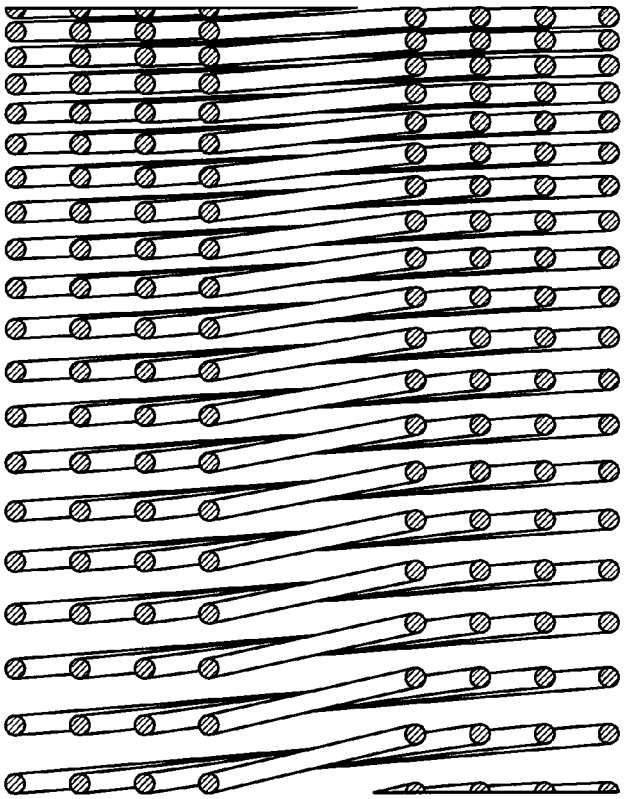

FIG. 11 is a view showing an example of four coil springs which are disposed concentrically such that each vibrates and oscillates without colliding with any other.

<<Examples of 5 Coil Springs>>

Figure 12:
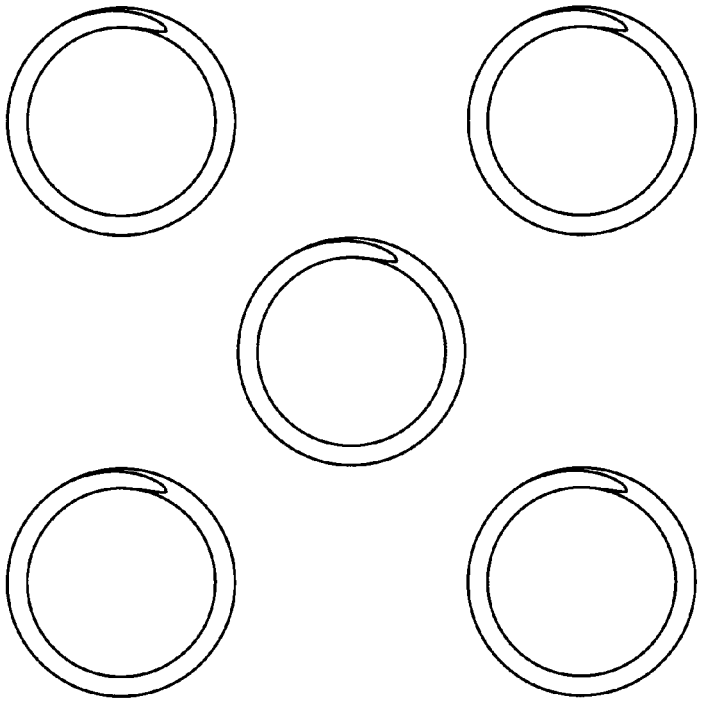
FIG. 12 is a view showing an example of five coil springs.
Figure 12:
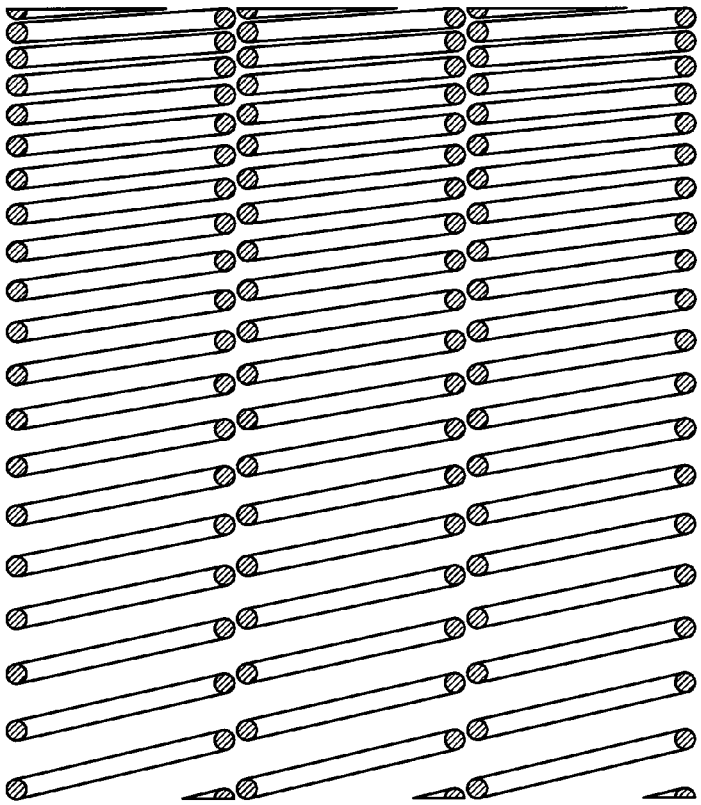

FIG. 12 is a view showing an example of five coil springs.

<<Examples of 5 Co-Circumferential Coil Springs>>

Figure 13:
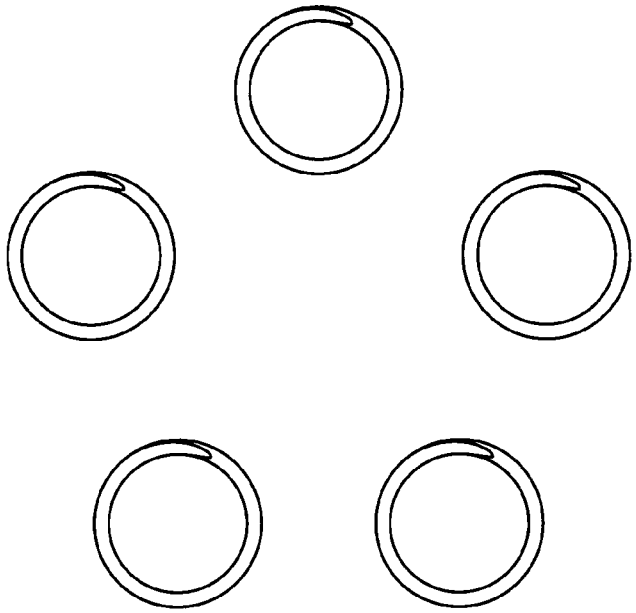
FIG. 13 is a view showing an example of five coil springs which are disposed on a same circumference.
Figure 13:
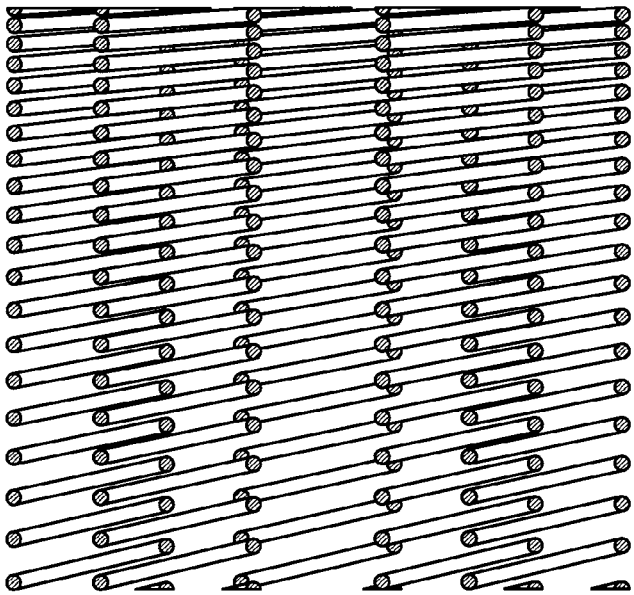

FIG. 13 is a view showing an example of five coil springs which are disposed on a same circumference.

<<Examples of 5 Co-Circumferential Coil Springs and Large Coil Spring>>

Figure 14:
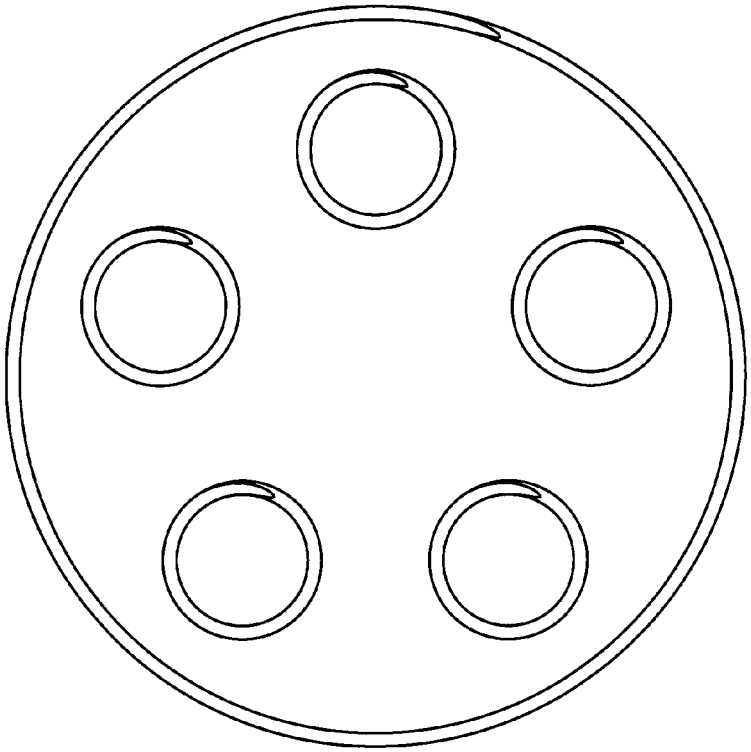
FIG. 14 is a view showing an example of five coil springs which are disposed on a same circumference, and a large coil spring accommodating them.
Figure 14:
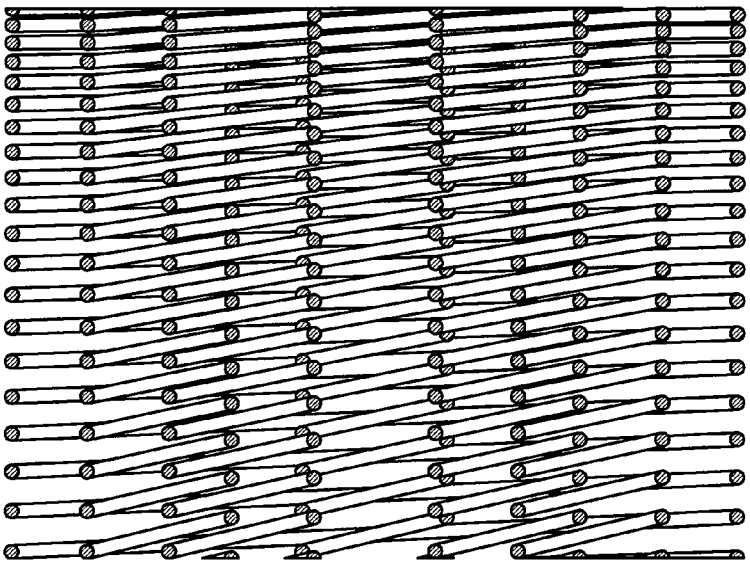

FIG. 14 is a view showing an example of five coil springs which are disposed on a same circumference, and a large coil spring accommodating them.

<<Examples of 5 Sets of 3 Concentric Coil Springs>>

Figure 15:
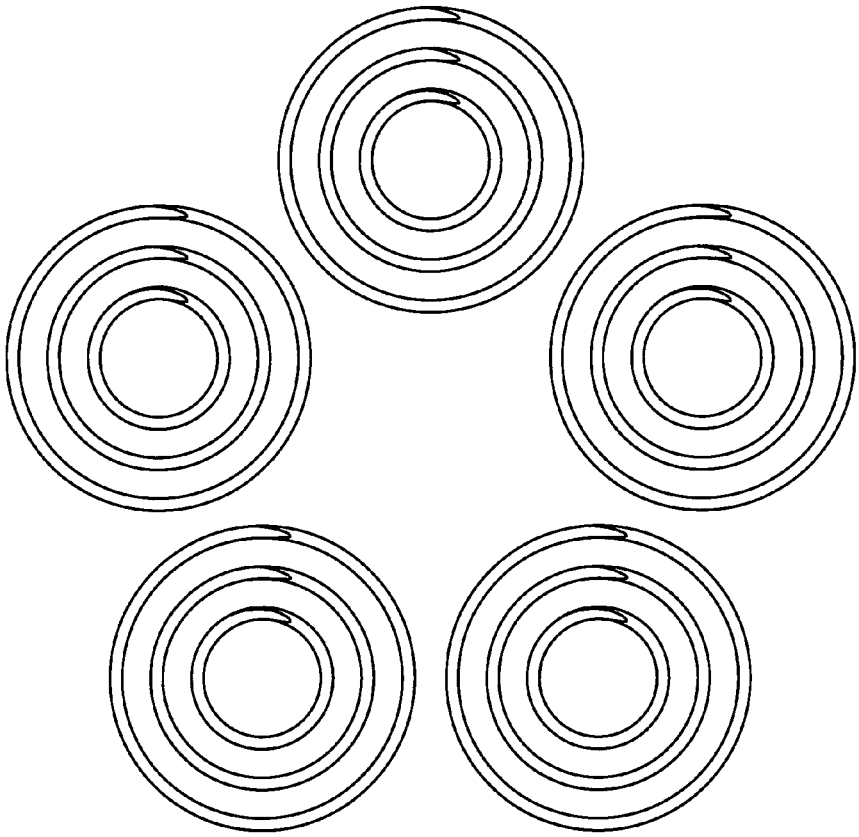
FIG. 15 is a is a view showing an example of five sets of three concentrically-disposed coil springs, the sets being disposed on a same circumference.
Figure 15:
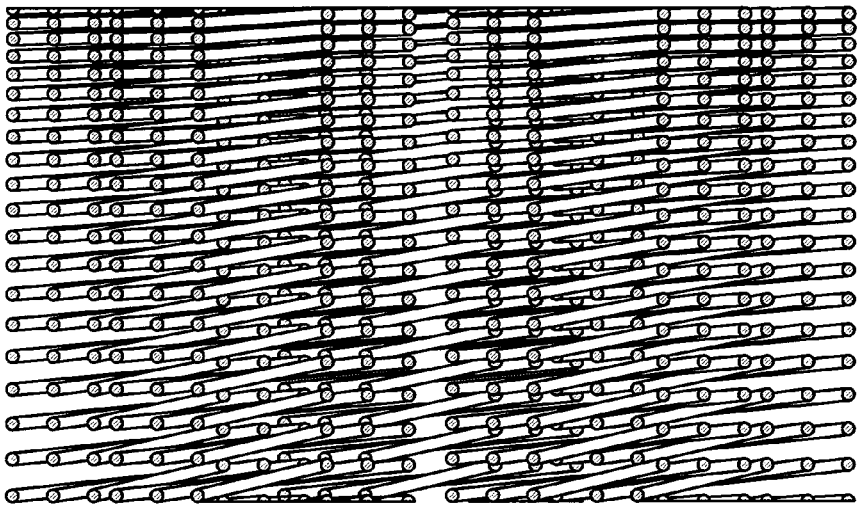

FIG. 15 is a is a view showing an example of five sets of three concentrically-disposed coil springs, the sets being disposed on a same circumference.

Figure 16:
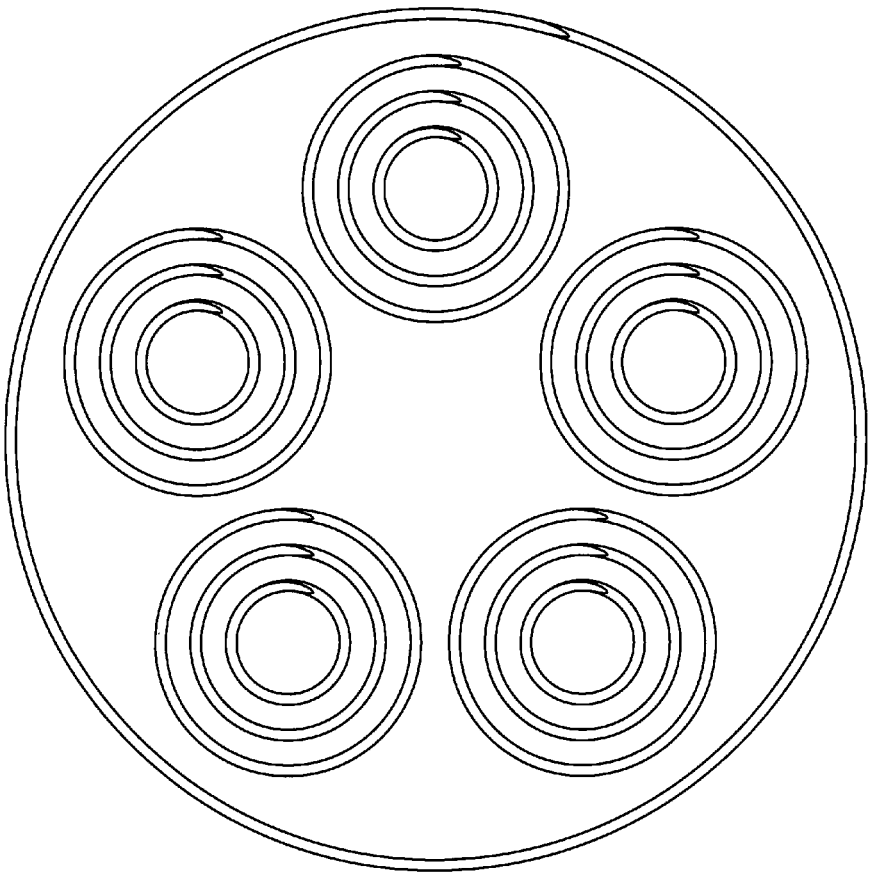
FIG. 16 a is a view showing an example of five sets of three concentrically-disposed coil springs and a large coil spring accommodating them, the sets being disposed on a same circumference.
Figure 16:
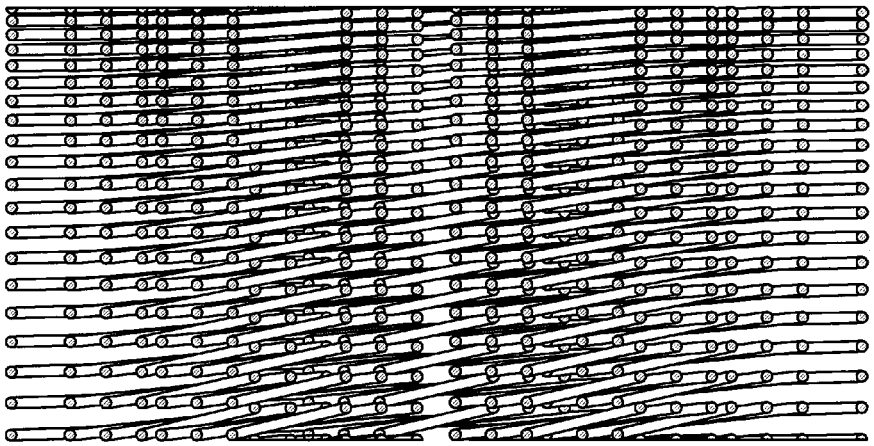

FIG. 16 a is a view showing an example of five sets of three concentrically-disposed coil springs and a large coil spring accommodating them, the sets being disposed on a same circumference.

The examples shown in FIGS. 10 to 16 employing a number of coil springs are advantageously adapted to a liquefaction promoting apparatus which is applied to a high power heat pump system. In the examples shown in FIGS.

10 to 16, the coil springs may be designed to have various pitches and various diameters and combinations of such.

REFERENCE SYMBOLS 1, 2 liquefaction promoting apparatus
10 cylindrical housing
11 body part
12 upper dome-shaped end plate
13 lower dome-shaped end plate
20 large coil spring
21, 22, 23, 24 fixing part
30 small coil spring
31, 32, 33, 34 fixing part
60 upper tube, or inlet/outlet (in cooling/heating operation)
60*a* lower end of upper tube
70 lower tube, or outlet/inlet (in cooling/heating operation)
70*a* upper end of lower tube expander
82 indoor unit, or evaporator/condenser (in cooling/heating operation)
83 compressor
84 outdoor unit, or condenser/evaporator (in cooling/heating operation).

What is claimed is:

1. A liquefaction promoting apparatus to be disposed on a pipeline of a heat pump system for the purpose of stirring and uniformly mixing fluid containing refrigerant and refrigerator oil circulating therein comprising:

a cylindrical housing having a central axis, a body part having an inner diameter and an upper end and a lower end, and an upper and a lower dome-shaped end plates, each of the upper and lower dome-shaped end plates sealing a respective one of the upper and the lower ends of said body part;

an upper tube having one end connectable to the pipeline and another end penetrating said upper dome-shaped end plate at a spaced apart position from the central axis of the cylindrical housing and extending to the periphery of the upper end of said body part, allowing the fluid to flow therethrough;

a lower tube having one end connectable to the pipeline and another end penetrating said lower dome-shaped end plate at the central axis of said cylindrical housing and extending to the periphery of the upper end of said body part, allowing the fluid to flow therethrough;

a large coil spring extending internally and longitudinally along said body part, said large coil spring having a first end and a second end affixed to said body part, and a middle part connecting said first and second ends, said large coil spring having an outer diameter of 1 to 10 mm smaller than the inner diameter of said body part, the middle part being unfixed to said body part to vibrate and oscillate;

wherein the middle part of said large coil spring vibrates and oscillates when actuated by kinetic energy of the fluid flowing in the cylindrical housing, thereby stirring the fluid.

2. The liquefaction promoting apparatus as set forth in claim 1, further comprising at least one small coil spring having a diameter of 1 to 30 mm larger than an outer diameter of said lower tube, said at least one small coil spring being accommodated in said body part in a surrounding relationship with said lower tube, said at least one small coil spring having its upper end fixed on said one end of said lower tube and its lower end extending to the periphery of said lower dome-shaped end plate;

wherein said at least one small coil spring vibrates and oscillates without colliding with said large coil spring.

3. The liquefaction promoting apparatus as set forth in claim 2, wherein said at least one small coil spring is unequally pitched in such a manner that its upper part has a wide pitch size, its middle part has a narrow pitch size and its lower part has a wide pitch size, or that its upper part has a narrow pitch size, its middle part has a wide pitch size and its lower part has a narrow pitch size.

4. The liquefaction promoting apparatus as set forth in claim 2, further comprising at least three coil springs, each of said at least three coil springs being selected from a group consisting of said large coil spring, said at least one small coil spring, and combination thereof.

5. The liquefaction promoting apparatus as set forth in claim 1, wherein said large coil spring is unequally pitched in such a manner that its upper part has a wide pitch size, its middle part has a narrow pitch size and its lower part has a wide pitch size, or that its upper part has a narrow pitch size, its middle part has a wide pitch size and its lower part has a narrow pitch size.

6. The liquefaction promoting apparatus as set forth in claim 1, wherein said another end of said upper tube is inclined upward in the radial direction away from the central axis of said cylindrical housing.

7. A method for promoting liquefaction of a fluid by stirring and uniformly mixing said fluid in a liquefaction promoting apparatus operating in a cooling mode of operation or in a heating mode of operation, the method comprising:

configuring a liquefaction promoting apparatus having:

a cylindrical housing having a central axis, a body part having an inner diameter and an upper end and a lower end, and an upper and a lower dome-shaped end plates, each of the upper and lower dome-shaped end plates sealing a respective one of the upper and the lower ends of said body part, an upper tube having one end connected to the pipeline and another end penetrating said upper dome-shaped end plate at a spaced apart position from the central axis of the cylindrical housing and extending to the periphery of the upper end of said body part, allowing the fluid to flow therethrough, a lower tube having one end connectable to the pipeline and another end penetrating said lower dome-shaped end plate at the central axis of said cylindrical housing and extending to the periphery of the upper end of said body part, allowing the fluid to flow therethrough, a large coil spring extending internally and longitudinally along said body part, said large coil spring having a first end and a second end affixed to said body part, and a middle part connecting said first and second ends, said large coil spring having an outer diameter of 1 to 10 mm smaller than the inner diameter of said body part, the middle part being unfixed to said body part to vibrate and oscillate, and at least one small coil spring accommodated in said body part in a surrounding relationship with said lower tube, said at least one small coil spring having its upper end fixed on said one end of said lower tube and its lower end extending to the periphery of said lower dome-shaped end plate, wherein the middle part of said large coil spring and said at least one small coil spring vibrate and oscillate when actuated by kinetic energy of the fluid flowing in the cylindrical housing, thereby stirring the fluid, and wherein said at least one small coil spring vibrates and oscillates without colliding with said large coil spring;

in said cooling mode of operation, entering the fluid containing refrigerant and refrigerator oil through said upper tube from a condenser, or an outdoor unit disposed on the pipeline;

stirring and uniformly mixing the fluid by the action of vibration and oscillation of said large coil spring and said at least one small coil spring; and expelling the fluid through said lower tube.

8. The method for promoting liquefaction of the fluid by stirring and uniformly mixing said fluid in the liquefaction promoting apparatus as set forth in claim 7, further comprising:

in said heating mode of operation, entering the fluid containing refrigerant and refrigerator oil through said lower tube;

stirring and uniformly mixing the fluid by the action of vibration and oscillation of said large coil spring and said at least one small coil spring; and expelling the fluid through said upper tube to an evaporator, or an outdoor unit disposed on the pipeline.

9. A liquefaction promoting apparatus to be disposed on a pipeline of a heat pump system for the purpose of stirring and uniformly mixing fluid containing refrigerant and refrigerator oil circulating therein comprising:

a cylindrical housing having a central axis, a body part having an inner diameter and an upper end and a lower end, and an upper and a lower dome-shaped end plates, each of the upper and lower dome-shaped end plates sealing a respective one of the upper and the lower ends of said body part;

an upper tube having one end connectable to the pipeline and another end penetrating said upper dome-shaped end plate at a spaced apart position from the central axis of the cylindrical housing and extending to the periphery of the upper end of said body part, allowing the fluid to flow therethrough;

a lower tube having one end connectable to the pipeline and another end penetrating said lower dome-shaped end plate at the central axis of said cylindrical housing and extending to the periphery of the upper end of said body part, allowing the fluid to flow therethrough;

a large coil spring extending internally and longitudinally along said body part, said large coil spring having a first end and a second end affixed to said body part, and a middle part connecting said first and second ends, said large coil spring having an outer diameter of 1 to 10 mm smaller than the inner diameter of said body part, the middle part being unfixed to said body part to vibrate and oscillate; and at least one small coil spring accommodated in said body part in a surrounding relationship with said lower tube, said at least one small coil spring having its upper end fixed on said one end of said lower tube and its lower end extending to the periphery of said lower dome-shaped end plate;

wherein the middle part of said large coil spring and said at least one small coil spring vibrate and oscillate without colliding with one with another when actuated by kinetic energy of the fluid flowing in the cylindrical housing, thereby stirring the fluid.

10. The liquefaction promoting apparatus as set forth in claim 9, wherein said at least one small coil spring has a diameter of 1 to 30 mm larger than an outer diameter of said lower tube.

11. The liquefaction promoting apparatus as set forth in claim 9, wherein said large coil spring is unequally pitched in such a manner that its upper part has a wide pitch size, its middle part has a narrow pitch size and its lower part has a wide pitch size, or that its upper part has a narrow pitch size, its middle part has a wide pitch size and its lower part has a narrow pitch size.

12. The liquefaction promoting apparatus as set forth in claim 9, wherein said at least one small coil spring is unequally pitched in such a manner that its upper part has a wide pitch size, its middle part has a narrow pitch size and its lower part has a wide pitch size, or that its upper part has a narrow pitch size, its middle part has a wide pitch size and its lower part has a narrow pitch size.

13. The liquefaction promoting apparatus as set forth in claim 9, wherein said another end of said upper tube is inclined upward in the radial direction away from the central axis of said cylindrical housing.

14. The liquefaction promoting apparatus as set forth in claim 9, further comprising at least three coil springs, each of the at least three coil springs being selected from a group consisting of said large coil spring, said at least one small coil spring, and combination thereof.

* * * * *